United States Patent [19]

Rosenberg et al.

[11] 4,356,974

[45] Nov. 2, 1982

[54] SPRAY NOZZLES

[76] Inventors: Peretz Rosenberg; Avner Rosenberg, both of Moshav Beit Shearim, Israel

[21] Appl. No.: 228,759

[22] Filed: Jan. 27, 1981

Related U.S. Application Data

[63] Continuation-in-part of Ser. No. 88,071, Oct. 24, 1979, abandoned.

[51] Int. Cl.[3] ..... B05B 1/26

[52] U.S. Cl. ..... 239/382; 239/499; 239/506; 239/524

[58] Field of Search ..... 239/222.17, 380–383, 239/453, 454, 461, 499, 505, 506, 508, 512, 514–516, 518, 524

[56] References Cited

U.S. PATENT DOCUMENTS 3,958,760 5/1976 Rosenberg ..... 239/524 X 4,103,827 8/1978 Kumazawa ..... 239/515 X

*Primary Examiner*—Johnny D. Cherry

*Attorney, Agent, or Firm*—Benjamin J. Barish

[57] ABSTRACT

A spraying device is described comprising a nozzle formed with an outlet orifice through which the fluid issues in the form of a jet, and a cup-shaped member having a thin wall defining an open end of slightly larger diameter than the outlet orifice. The cup-shaped member is floatingly mounted for lateral and axial movement with respect to the nozzle orifice such that the jet issuing therefrom always impinges the cup-shaped member within its open end. The device further includes limiting means limiting the floating movement of the cup-shaped member.

10 Claims, 5 Drawing Figures

SPRAY NOZZLES

This is a continuation-in-part of application Ser. No. 088,071, filed Oct. 24, 1979, now abandoned.

BACKGROUND OF THE INVENTION

The present invention relates to spray nozzles or spraying devices, and particularly to the type of spraying device described in U.S. Pat. No. 3,958,760.

The above-cited patent describes a spraying device comprising a nozzle formed with an outlet orifice through which the fluid issues in the form of a jet, and a deflector supported close to and in alignment with the nozzle orifice so as to be impinged by the jet issuing therefrom. The deflector is floatingly mounted with respect to the nozzle so as to be movable in a lateral direction, and preferably also in an axial direction, with respect to its orifice and is formed with a recess centrally of the face thereof impinged by the jet which recess is effective to automatically self-center the deflector with respect to the orifice. The nozzle further includes limiting means limiting the floating movement of the deflector with respect to the nozzle orifice.

Such spraying devices have many advantages over the then-known devices and are therefore enjoying a high degree of commercial success. The present invention is directed to a construction which has been found to produce even further important advantages as will be described more fully below.

BRIEF SUMMARY OF THE INVENTION

According to a broad aspect of the present invention, there is provided a spraying device comprising a nozzle formed with an outlet orifice through which the fluid issues in the form of a jet, a cup-shaped member having an open end supported close to and in alignment with said orifice so as to be impinged by the jet issuing therefrom, said cup-shaped member being floatingly mounted with respect to the nozzle so as to be movable both in a lateral direction with respect to said orifice and in an axial direction towards and away from said orifice, and limiting means limiting the floating movement of the cup-shaped member with respect to the nozzle orifice, the open end of the cup-shaped member facing the orifice being defined by a thin wall whose thickness is a small fraction of the diameter of its open end, the inner diameter of the cup-shaped member being slightly larger than the sum of the outlet orifice diameter and the maximum lateral movement permitted by the limiting means.

Such an arrangement provides a number of important advantages over the constructions illustrated in the above-cited patent. Thus, whereas in the patent-illustrated constructions the deflection of the water jet is effected by impingement against rigid surfaces (i.e., against the confronting faces of the recessed deflector and nozzle), in the novel construction of the present invention the deflection is effected by impingement against a fluid cushion produced within the cup-shaped member. Moreover, it was found that during the operation of the patent-illustrated constructions the narrow space defined by the extensive confronting rigid faces of the deflector and nozzle resulted in low-pressure areas which caused the deflector to vibrate rapidly in the axial direction, i.e. towards and away from the nozzle orifice, which not only increased the impacting of the water jet against rigid surfaces but also dissipated energy of the pressurized water supply line. Since the novel arrangement of the present invention does not include these extensive rigid surfaces which are inpacted by the water jet, and which produce the axial vibratory movement of the jet-impinged member, it was found that this novel arrangement:produces droplets which are considerably more mist-free and more uniform in size and distribution; is capable of operating at significantly lower line pressures (e.g., as low as 0.5 atmospheres) thereby lowering energy costs and in some cases even obviating the need for a pump; is less sensitive to clogging, and, in the event of clogging, is easier cleanable by back-flushing; and can also be produced at lower cost.

BRIEF DESCRIPTION OF THE DRAWINGS

The invention is herein described, by way of example only, with reference to the accompanying drawings wherein.

DESCRIPTION OF PREFERRED EMBODIMENTS

Figure 1:
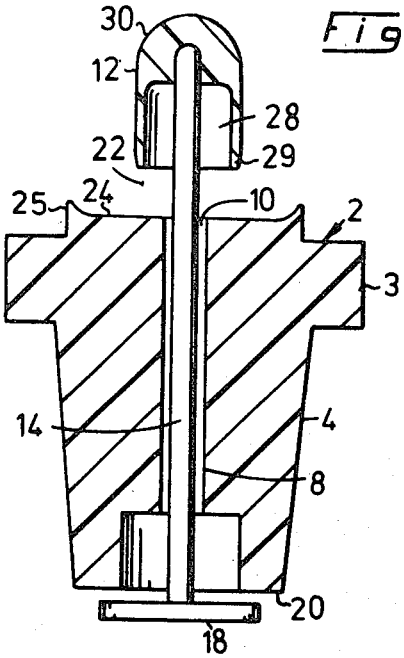
FIG. 1 is a sectional view illustrating a spraying device constructed in accordance with the invention.
Figure 2:
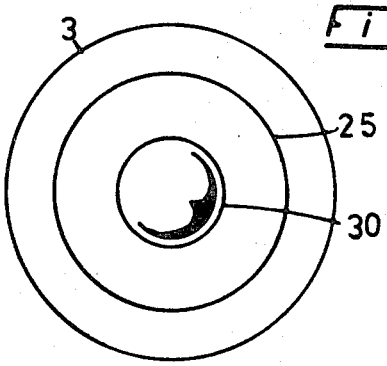
FIG. 2 is a top view of the device of FIG. 1.

The spraying device illustrated in FIGS. 1 and 2 is of the general type described in the patent cited in the opening paragraph hereof. It includes a nozzle, generally designated 2, formed with upper head 3 and a lower conical end 4 for attachment, by a friction fit, into a water supply device (not shown). Nozzle 2 is formed with an axial bore 8 communicating at one end (the lower end) with the water supply pipe and terminating at the opposite end in an outlet orifice 10 through which the water issues in the form of a jet.

A cup-shaped member 12 is supported close to and in alignment with nozzle orifice 10 so as to be impinged by the jet issuing from the orifice. The cup-shaped member 12 is floatingly mounted by means of a rod 14 passing through nozzle bore 8. Rod 14 is of smaller diameter, and of greater length, than the nozzle bore, and its outer end is secured, e.g., by a friction fit, to the center of the cup-shaped member 12. The opposite end of rod 14 is formed with a cross-bar 18 of greater length than the diameter of the respective end of bore 8 so as to limit against the lower face 20 of the nozzle.

It will be seen that the rod 14 provides a floating mounting for the cup-shaped member 12, permitting the latter member to move in a lateral direction with respect to the nozzle orifice, and also in an axial direction, i.e., inwardly and outwardly towards and away from the nozzle orifice. The movement of the cup-shaped member 12 away from the nozzle orifice, as limited by cross-bar 18 engaging face 20 of the nozzle, produces an annular space 22 between the edge of the cup-shaped member 12 and the confronting face 24 of the nozzle, through which annular space the water issues in the form of an annular spray. The confronting face 24 of the nozzle is substantially flat but may be formed with an upwardly inclined surface 25 at its outer margin to produce inclined spraying.

The diameter of the open end of the cup-shaped member 12 is slightly larger than the diameter of the orifice 10 together with the maximum lateral floating movement permitted by rod 14; as one example, orifice 10 may be 2 mm, rod 14 may be 1.5 mm, and the diameter of the open end of the cup-shaped member 12 may be 2.6 mm. The depth of the cup-shaped member (i.e., the longitudinal dimension of space 28 between the outer edge 29 of the member and its closed bottom wall 30) should be at least one-half the diameter of its open end; in the illustrated example, this depth is about equal to the diameter of the open end of the cup-shaped member 12, i.e., about 2.6 mm. In addition, the thickness of the wall of the cup-shaped member 12 at its open substantially cylindrical end should be a small fraction of the diameter of its open end; in the illustrated example, this thickness is about 0.5 mm, which is about one-fifth of the diameter at its open end. Preferably, the outer rim 29 of the cup-shaped member is formed with a relatively sharp edge. Also, outward movement of the cup-shaped member 12 is limited to a distance less than the diameter of its open end; and its lateral movement is limited to a distance less than half the diameter of its open end.

When the spraying device illustrated in FIGS. 1 and 2 is in use, the cup-shaped member 12 is biased by gravity to move against face 24 of the nozzle, thereby closing orifice 10. Accordingly, when no water is flowing through the spraying device its orifice is automatically closed against the possible entry of insects or dust particles which might tend to clog it.

As soon as the water supply is turned on, the water jet issuing through the nozzle orifice 10 impinges against the bottom wall of the cup-shaped member 28 producing a water cushion within the member and moving the member outwardly until the cross-bar 18 of rod 14 limits against face 20 of the nozzle thereby producing the annular space 22 through which the water spray issues.

It will thus be seen that the water spray is not produced by striking against rigid surfaces such as in the constructions illustrated in the above-cited patent, but rather by striking a water cushion produced within the cup-shaped member 12 (i.e., space 28) and within the space between rim 29 of member 12 and the face 24 of the nozzle orifice 10. Producing the spray in this manner has been found to substantially decrease the mist and increase the uniformity of the water droplets which are highly desirable, particularly in water irrigation, to lower evaporation and wind-drift losses and to provide better distribution.

As also indicated earlier, the foregoing construction imparts other advantages. Thus, it reduces the required line pressure to operate the sprayer. It also provides less sensitivity to clogging since there are substantially no closely-spaced rigid surfaces between which dirt particles may become wedged, as for example, in the constructions illustrated in the above-cited patent. In this connection, the flat face 24 of nozzle 4 through which the outlet orifice 10 is formed, may be of substantially smaller area than in the above-cited patent, as can be seen from FIG. 1. Preferably, the diameter of face 24 is less than five times (in the illustrated arrangement it is approximately twice) the diameter of the open end of the cup-shaped member 12.

Face 24 is substantially flat but may be formed with an upwardly inclined surface 25 at its outer margin as mentioned above for inclined spraying.

Figure 3:
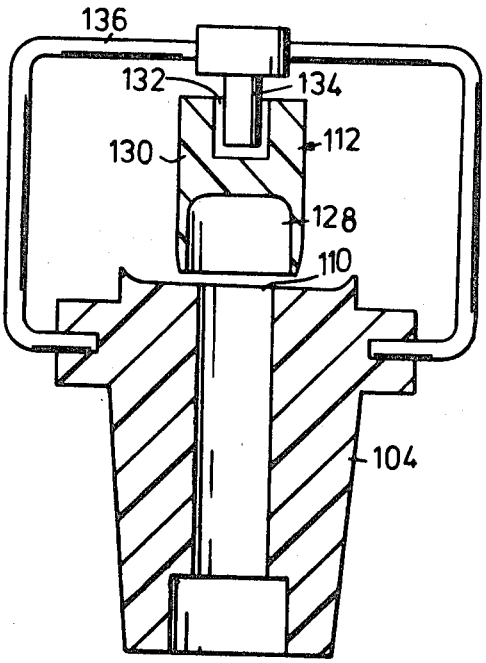
FIG. 3 is a sectional view illustrating another spraying device constructed in accordance with the invention.

FIG. 3 illustrates a second embodiment of the invention particularly directed to another arrangement for limiting the movement of the floating cup-shaped member. Thus, in FIG. 3, the nozzle is generally designated 104; and the cup-shaped member is generally designated 112 and is disposed with its open end 128 in alignment with the nozzle orifice 110 as described with respect to FIGS. 1 and 2. In the embodiment of FIG. 3, however, the bottom wall 130 of the cup-shaped member 112 is formed with a recess 132 receiving a rod 134 carried by a U-shaped member 136, the end arms of the latter member being received within the enlarged head of the nozzle 104. The cross-sectional area of recess 132 is slightly larger than that of rod 134 so as to permit the cup-shaped member 112 to float both laterally of the nozzle orifice 110 and also towards and away from that orifice. In substantially all other respects, the construction and operation of the embodiment of FIG. 3 is the same as described above with respect to FIGS. 1 and 2.

Figure 4:
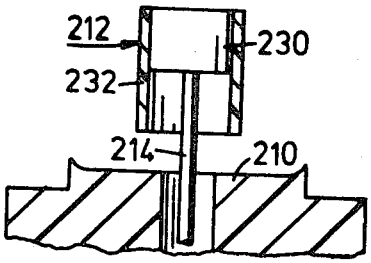
FIG. 4 is a fragmentary view illustrating a further spraying device construction in accordance with the invention.

FIGS. 4 and **4*a* illustrate a further embodiment of the invention, wherein the cup-shaped member, therein designated 212, is carried by a rod 214 passing through the nozzle orifice 210. In this construction, however, the cup-shaped member 212 is constituted of an enlarged end 230 integrally formed at the upper end of rod 214, and a short flexible plastic sleeve 232 frictionally received over the enlarged end 230. Sleeve 232, for example, could be of thin-walled flexible plastic material (e.g., polyvinyl chloride, polyethylene, or the like) having a wall thickness of about 0.1 mm. The structure of the FIG. 4 spray nozzle, particularly the dimensional relationships and the mode of operation, would otherwise be the same as described above with respect to FIG. 1**.

Figure 4A:
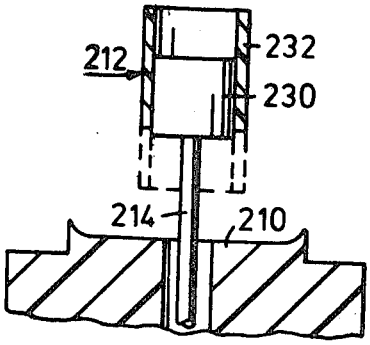
FIG. 4*a* illustrates the two modes of operation of the spraying device of FIG. 4.

The construction of FIG. 4, however, has a further advantage in that it is capable of two modes of operation. Thus, when the plastic sleeve 232 is in its lower position as illustrated in FIG. 4 (and in broken lines in FIG. **4*a*), wherein its lower end projects below the enclosed end of the rod facing the nozzle orifice, the device acts as a spray nozzle in the same manner as described above with respect to FIG. 1. However, when the sleeve 232 is moved to an upper position as illustrated in full lines in FIG. 4*a*, or is completely removed from the upper end 230 of rod 214, the water jet does not impinge a "water cushion" as described above, but rather impinges directly against the lower face of enlarged rod end 230**. It thereby may be converted to a misting device to produce a fine mist of water around the nozzle.

While the invention has been described with respect to several preferred embodiments, it will be appreciated that many other variations, modifications and applications of the invention may be made.

What is claimed is:

1. A spraying device comprising a nozzle formed with an outlet orifice through which the fluid issues in the form of a jet, a cup-shaped member having an open end supported close to and in alignment with said orifice so as to be impinged by the jet issuing therefrom, said cup-shaped member being floatingly mounted with respect to the nozzle so as to be movable both in a lateral direction with respect to said orifice and in an axial direction towards and away from said orifice, and limiting means limiting the floating movements of the cup-shaped member with respect to the nozzle orifice, the open end of the cup-shaped member facing the orifice being defined by a thin, substantially cylindrical wall whose thickness is a small fraction of the diameter of its open end, the inner diameter of the cup-shaped member being slightly larger than the sum of the outlet orifice diameter and the maximum lateral movement permitted by the limiting means, the surface of the nozzle facing the cup-shaped member around the nozzle orifice being substantially flat.

2. The device according to claim 1, wherein the depth of the cup-shaped member is at least one-half the diameter of its open end.

3. The device according to claim 1, wherein the outer rim of the cup-shaped member facing the orifice has a relatively sharp edge.

4. The device according to claim 1, wherein said cup-shaped member is biased by its own weight to close the nozzle orifice upon the termination of the jet therefrom.

5. The device according to claim 4, wherein the outward movement of the cup-shaped member is limited by said limiting means to a distance less than the diameter of the open end of the cup-shaped member.

6. The device according to claim 5, wherein the lateral movement of the cup-shaped member is limited by said limiting means to a distance less than one-half the diameter of the open end of the cup-shaped member.

7. The device according to claim 1, wherein the limiting means comprises a rod of greater length, and of smaller diameter, than the nozzle orifice and passing therethrough, the outer end of the rod being attached to the center of the bottom wall of the cup-shaped member, and the inner end of the rod including a stop limiting the outward movement of the rod and the cup-shaped member with respect to the nozzle orifice.

8. The device according to claim 1, wherein the bottom wall of the cup-shaped member is formed with a recess in its outer face, and wherein said limiting means includes a U-shaped rod having two legs attached to the nozzle and carrying a second rod at its center of smaller cross-sectional area than, and seatable within, said recess in the bottom wall of the cup-shaped member.

9. The device according to claim 1, wherein said cup-shaped member is carried by a rod passing through said nozzle orifice, and is constituted of an enlarged end of said rod and a flexible plastic sleeve received thereover such that one end of the sleeve projects below the enclosed end of the rod facing the nozzle orifice.

10. The device according to claim 9, wherein said flexible plastic sleeve is frictionally received on said enlarged rod end, and is removable therefrom so as to convert the device to a misting device.

* * * * *